US008141858B2

(12) United States Patent
Morfey

(10) Patent No.: US 8,141,858 B2
(45) Date of Patent: Mar. 27, 2012

(54) CLAMP

(75) Inventor: Stephen John Morfey, London (GB)

(73) Assignee: Prosurgics Limited, Bucks (GB)

( * ) Notice: Subject to any disclaimer, the term of this patent is extended or adjusted under 35 U.S.C. 154(b) by 336 days.

(21) Appl. No.: 12/272,937

(22) Filed: Nov. 18, 2008

(65) Prior Publication Data

US 2009/0140480 A1 Jun. 4, 2009

(30) Foreign Application Priority Data

Nov. 29, 2007 (GB) ..... 0723406.5

(51) Int. Cl.
*B25B 5/02* (2006.01)

(52) U.S. Cl. ..... 269/171; 269/42; 269/107

(58) Field of Classification Search ..... 269/171, 269/107, 110, 138, 172, 137
See application file for complete search history.

(56) References Cited

U.S. PATENT DOCUMENTS

| | | | | | |
|---|---|---|---|---|---|
| 500,364 | A * | 6/1893 | Baker | 269/55 |
| 742,281 | A * | 10/1903 | Blake | 269/171 |
| 1,194,666 | A * | 8/1916 | Romanowski | 269/110 |
| 1,402,621 | A * | 1/1922 | Knittel et al. | 269/156 |
| 1,788,546 | A * | 1/1931 | Schmieder | 269/37 |
| 1,841,196 | A * | 1/1932 | Mass | 269/104 |
| 2,422,773 | A * | 6/1947 | Colwill | 269/99 |
| 2,498,725 | A * | 2/1950 | Thornburg | 269/107 |
| 2,599,010 | A * | 6/1952 | Kalman | 269/55 |
| 2,620,839 | A * | 12/1952 | Tyler | 269/89 |
| 2,642,905 | A * | 6/1953 | Thomas | 269/93 |
| 3,537,337 | A * | 11/1970 | Best | 408/95 |
| 4,552,345 | A * | 11/1985 | Benda et al. | 269/43 |
| 4,736,935 | A * | 4/1988 | Vasapolli | 269/137 |
| 4,750,722 | A * | 6/1988 | Chick | 269/110 |
| 4,796,846 | A * | 1/1989 | Meier et al. | 248/286.1 |
| 4,957,257 | A * | 9/1990 | Gonzalez | 296/156 |
| 5,005,813 | A * | 4/1991 | Lawrence | 269/236 |
| 5,192,060 | A * | 3/1993 | Novak | 269/147 |
| 5,697,601 | A * | 12/1997 | Gurule | 269/43 |
| 5,863,033 | A * | 1/1999 | Bradford | 269/3 |
| 6,220,589 | B1 * | 4/2001 | Smith et al. | 269/156 |
| 6,491,294 | B1 * | 12/2002 | Hyatt | 269/41 |
| 6,595,401 | B2 * | 7/2003 | Collot et al. | 228/44.3 |
| 6,889,968 | B1 * | 5/2005 | Wong | 269/91 |
| 7,114,714 | B2 * | 10/2006 | Wong | 269/45 |
| 2002/0074705 | A1 | 6/2002 | Marusiak | |
| 2004/0239133 | A1 | 12/2004 | Kushnir | |
| 2009/0140480 | A1 * | 6/2009 | Morfey | 269/171 |

FOREIGN PATENT DOCUMENTS

| | | |
|---|---|---|
| DE | 3423054 | 1/1986 |
| DE | 19955363 A1 | 8/2001 |
| DE | 102005027202 A1 | 12/2006 |
| GB | 2291460 | 6/1994 |
| WO | WO 03/028612 | 4/2003 |

OTHER PUBLICATIONS

European search report and search opinion dated Aug. 11, 2009 for Application No. 08169658.5.

* cited by examiner

*Primary Examiner* — Lee D Wilson
*Assistant Examiner* — Jamal Daniel
(74) *Attorney, Agent, or Firm* — Wilson Sonsini Goodrich & Rosati

(57) ABSTRACT

A clamp adapted to be removably fixed to a further object. The clamp includes first and second clamp members, each being configured to apply a clamping force to the further object to which the clamp is removably fixed. One clamp actuator is adapted to drive movement of both the first and second clamp members with respect to each other along respective first and second axes. The first axis intersects the second axis.

10 Claims, 5 Drawing Sheets

CLAMP

CROSS-REFERENCE TO RELATED U.S. APPLICATIONS

Not applicable.

STATEMENT REGARDING FEDERALLY SPONSORED RESEARCH OR DEVELOPMENT

Not applicable.

NAMES OF PARTIES TO A JOINT RESEARCH AGREEMENT

Not applicable.

REFERENCE TO AN APPENDIX SUBMITTED ON COMPACT DISC

Not applicable.

BACKGROUND OF THE INVENTION

1. Field of the Invention

The present invention relates to a clamp.

2. Description of Related Art Including Information Disclosed Under 37 CFR 1.97 and 37 CFR 1.98.

There are situations in which it is desirable to clamp a first object to or in a fixed relationship with a second object. In some applications it is necessary to prevent movement of the first object along first and second axes with respect to the second object.

A so-called "dual action" clamp is shown in U.S. Pat. No. 5,863,033. This document discloses a clamp comprising a pair of pliers resiliently biased into a closed configuration such that a pair of jaws of the pliers may clamp an object placed there between. A plunger is located such that it may apply a force to an object which is clamped between the jaws of the pliers. Thus, it is possible to apply a clamping force to an object in two different directions.

A clamp of the type disclosed in U.S. Pat. No. 5,863,033, cannot be utilized in certain applications because there is no mechanism by way the jaws of the pliers or the plunger can be securely positioned so as to prevent movement of the object clamped there between when relatively high forces are applied to the object or the clamp. In other words, the resilient biasing mechanisms which hold the object within the clamp will release the object if a sufficiently high force is applied to either the object or the clamp. In addition, a user has little control over the clamping force which is applied to the object held in the clamp. Moreover, two actions are required to clamp the object: a first movement against the force of the plunger (with the jaws of the pliers held apart) and a second movement to release the jaws so as to clamp the object. This requirement for two movements (along perpendicular axes) by the user makes operation of the clamp difficult.

It is an object of the present invention to seek to ameliorate the problems associated with the prior art.

BRIEF SUMMARY OF THE INVENTION

Accordingly, one aspect of the present invention provides a clamp adapted to be removably fixed to a further object. The clamp comprises: first and second clamp members each configured to apply a clamping force to a further object to which the clamp is removably fixed; and one clamp actuator adapted to drive movement of both the first and second clamp members with respect to each other along respective first and second axes, wherein the first axis intersects the second axis.

In an embodiment, the first and second axes are substantially perpendicular to each other.

In an embodiment, the clamp actuator is configured to cause movement of the first clamp member and, when said movement of the first clamp member is substantially complete, to cause movement of the second clamp member.

In an embodiment, the clamp actuator comprises a motor.

In an embodiment, the clamp actuator comprises a rotatable shaft which is configured to drive movement of both the clamp members towards a closed position by rotation of the shaft in a first direction.

In an embodiment, the first clamp member defines a threaded aperture configured to cooperate with a threaded portion of the shaft such that rotation of the shaft causes movement of the first clamp member along the shaft.

In an embodiment, the second clamp member includes an inclined surface adapted to cooperate with an inclined surface on a driving wedge attached to the shaft such that linear movement of the shaft with respect to the second clamp member causes the driving wedge to drive movement of the second clamp member along the second axis.

In an embodiment, movement of the second clamp member is driven by the driving wedge after a movement of the first clamp member has ended.

In an embodiment, the clamp is a medical apparatus clamp.

BRIEF DESCRIPTION OF THE SEVERAL VIEWS OF THE DRAWINGS

An embodiment of the present invention shall now be described, by way of example, with reference to the accompanying drawings.

DETAILED DESCRIPTION OF THE INVENTION

Figure 1:
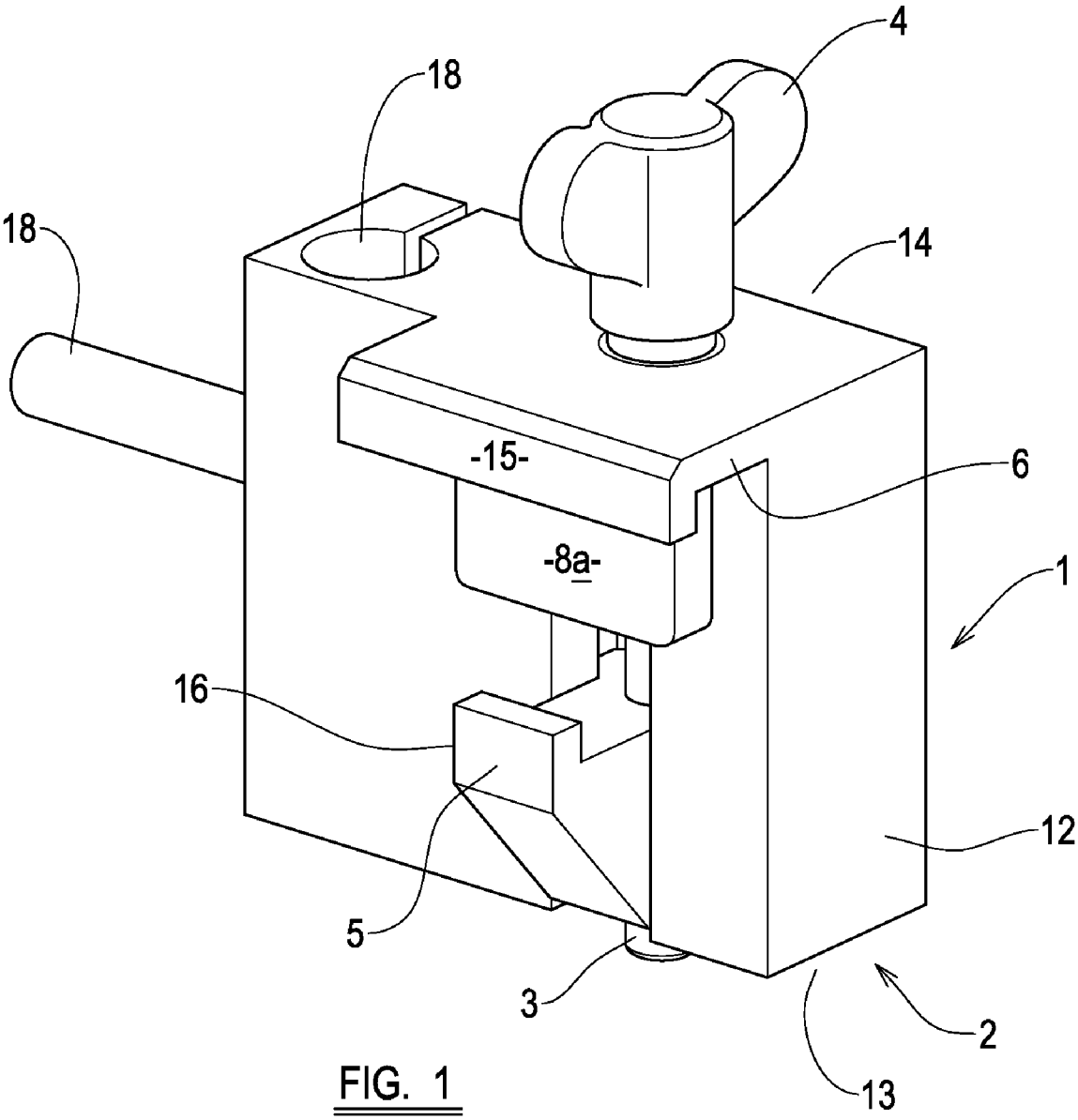
FIG. 1 shows a perspective view of a clamp in accordance with an embodiment of the present invention.
Figure 2:
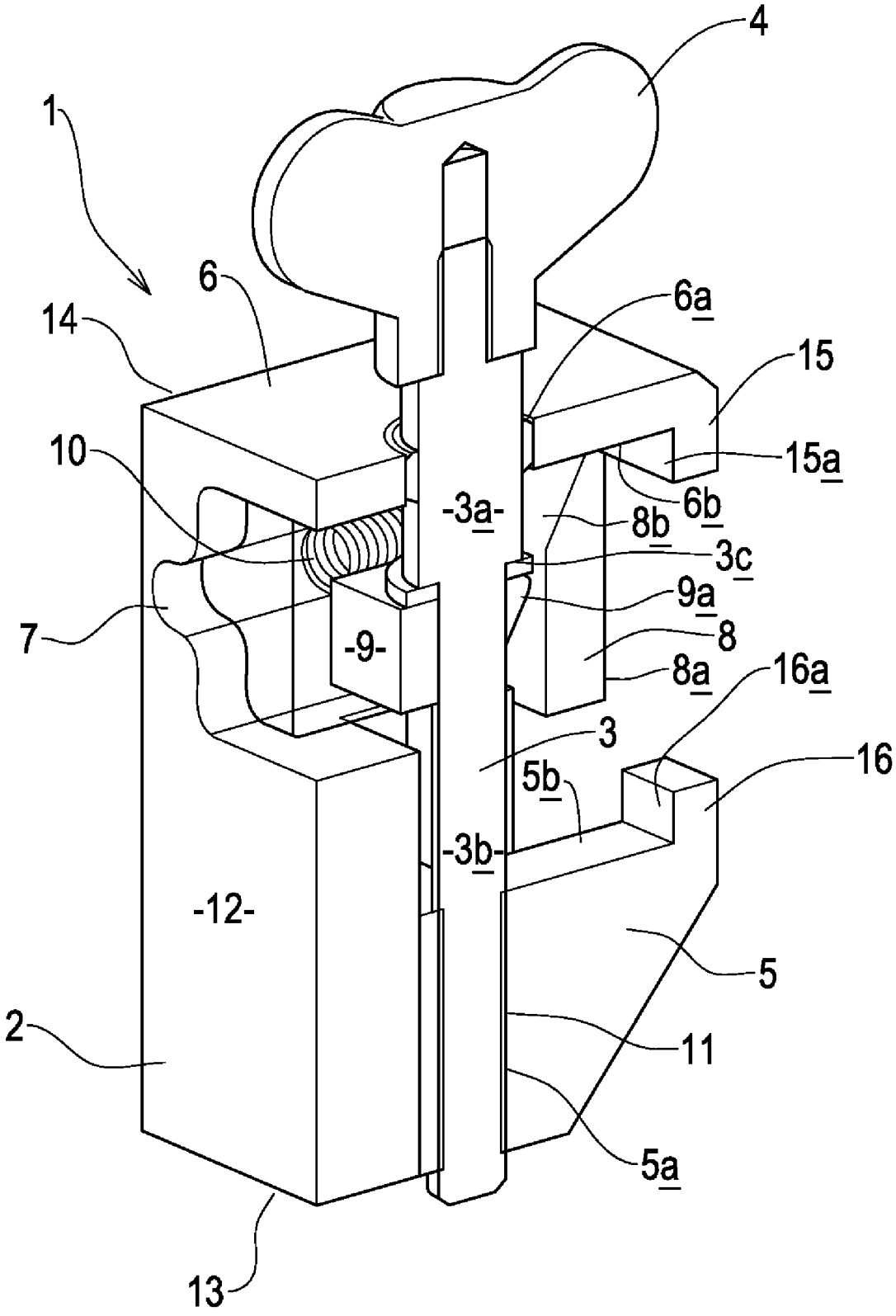
FIG. 2 shows a cross-sectional perspective view of a clamp in accordance with an embodiment of the present invention.

With reference to FIGS. 1 and 2, an embodiment of the present invention comprises a clamp 1. The clamp 1 has a housing 2 which, in turn, defines a central cavity and includes an elongate body 12 to one side of the cavity having a first end 13 and a second end 14.

A first jaw member 6 extends away from the elongate body 12 of the housing 2 at the second end 14 thereof. Preferably, the first jaw member 6 extends away from the elongate body 12 of the housing 2 along an axis which is approximately perpendicular to a longitudinal axis of the elongate body 12. The first jaw member has a first major abutment surface 6*b*.

A distal end of the first jaw member 6 includes a first abutment member 15 which projects away from the first jaw member 6 generally towards the first end 13 of the elongate body 12 of the housing 2. The first abutment member 15 has an inward facing abutment surface 15*a* which is generally parallel to the longitudinal axis of the elongate body 12 of the housing 2.

A shaft member 3 extends through an aperture 6*a* in the first jaw member 6 and is generally parallel to the longitudinal axis of the elongate body 12 of the housing 2. The shaft 3 comprises a first portion 3*a* having a first diameter and a second portion 3*b* having a second diameter (wherein the first diameter is larger than the second diameter). Thus, the shaft 3 extends through the first jaw member 6 such that it extends through the cavity and is generally adjacent to and parallel with the elongate body 12 of the housing 2. The second portion 3*b* of the shaft 3 is threaded. A generally annular surface 3*c* is located between the first 3*a* and second 3*b* portions of the shaft 3, presenting a shoulder between these first 3*a* and second 3*b* portions of the shaft 3.

The shaft 3 may include a handle 4 with one or more gripping members associated therewith. The handle is connected to the first portion 3*a* of the shaft 3 and is preferably at the end of the shaft 3.

The elongate body 12 of the housing 2 is configured to abut a corresponding wall of a second jaw member 5 so as to prevent rotation of the second jaw member 5 relative to the housing 2. This configuration may be a track (not shown). The second jaw member 5 generally opposes the first jaw member 6 and has an aperture 5*a* through an entire depth thereof which is suitable to receive the second portion 3*b* of the shaft 3. The aperture 5*a* has a thread 11. The second jaw member 5 has a second major abutment surface 5*b*, which generally faces the first jaw member 6.

The second jaw member 5 also includes a second abutment member 16 which projects from the lower jaw member towards the first abutment member 15. The second abutment member 16 has a second abutment surface 16*a* which is generally parallel to and aligned with the first abutment surface 15*a* of the first abutment member 15.

A slider receiving channel 7 is located at or near the second end 14 of the elongate body 12 of the housing 2. The slider receiving channel 7 is configured to receive a slider 8 (shown as transparent in the drawings so that the other features of the clamp 1 are readily visible). The slider 8 is adapted to move along the channel 7 in a direction which is generally perpendicular to the longitudinal axis of the elongate body 12 of the housing 2 and, therefore, generally perpendicular to the first 15*a* and second 16*a* abutment surfaces. The slider 8 includes a slider abutment surface 8*a* which is located at an end of the slider 8 which is closest to the abutment surfaces 15*a*,16*a*.

The slider 8 also includes an inclined surface 8*b* which opposes the slider abutment surface 8*a*.

A driving wedge 9 is provided towards an upper end of the second portion 3*b* of the shaft 3. Preferably, the driving wedge 9 has a hole therethrough which receives the second portion 3*b* of the shaft 3, and abuts the shoulder surface 3*c* between the first 3*a* and second 3*b* portions of the shaft 3. The driving wedge 9 includes an inclined surface 9*a* (at its end closest to the first 15 a and second 16*a* abutment surfaces). The inclined surface 9*a* of the driving wedge 9 is configured to cooperate with the corresponding inclined surface 8*b* of the slider 8.

A resilient biasing mechanism 10 is provided in order to bias the slider 8 away from the first and second abutment surfaces 15*a*, 16*a* towards the elongate body 12 of housing 2.

Figure 3:
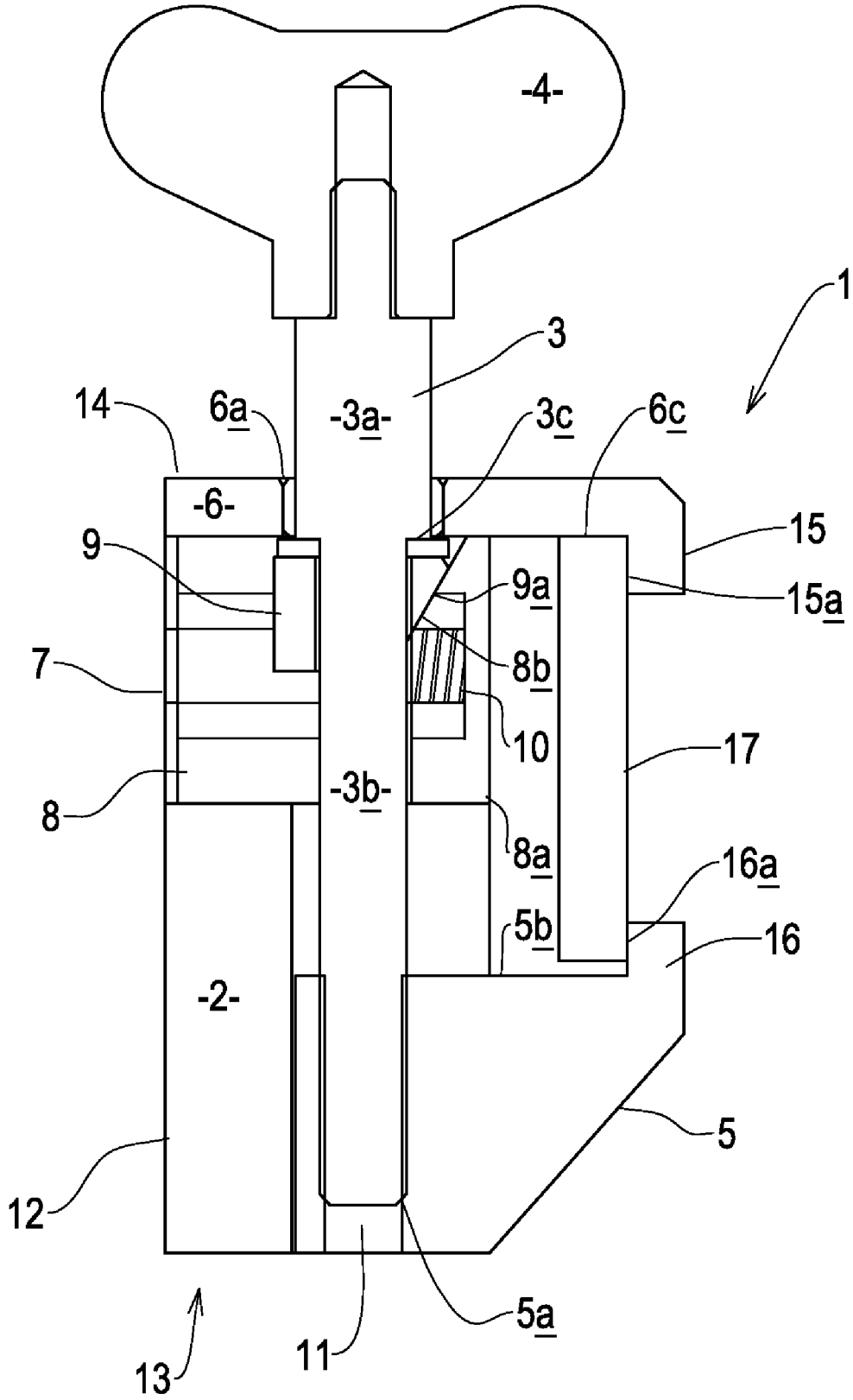
FIG. 3 shows a cross-sectional view if a clamp and rail in a first configuration.

In operation, the clamp 1 is in a first configuration as shown in FIG. 3. The driving wedge 9 is held towards the second end 14 of the elongate body 12 of the housing 2 by the inclined surface 8*b* of the slider 8 (which is biased towards the elongate body 12 of the housing 2).

An object 17 to be clamped by the clamp 1 is positioned between the first 6 and second 5 jaw members. The handle 4 attached to the shaft 3 is rotated in a direction such the threaded second portion 3*b* of the shaft 3 cooperates with the correspondingly threaded aperture 5*a* of the second jaw member 5. Because rotation of the second jaw member 5 is prevented by the configuration of the elongate body 12 which abuts a surface of the second jaw member 5, the second jaw member 5 moves along the second portion 3*b* of the shaft 3 towards the second end 14 of the elongate body 12 of the housing 2. The shaft 3 is generally prevented from movement through the aperture 6*a* towards the first end 13 of the elongate body 12 by the driving wedge 9 (which abuts the surface 3*c* between the first 3*a* and second 3*b* portions of the shaft 3 and which is biased towards the second end 14 of the elongate body 12 by the slider 8).

Figure 4:
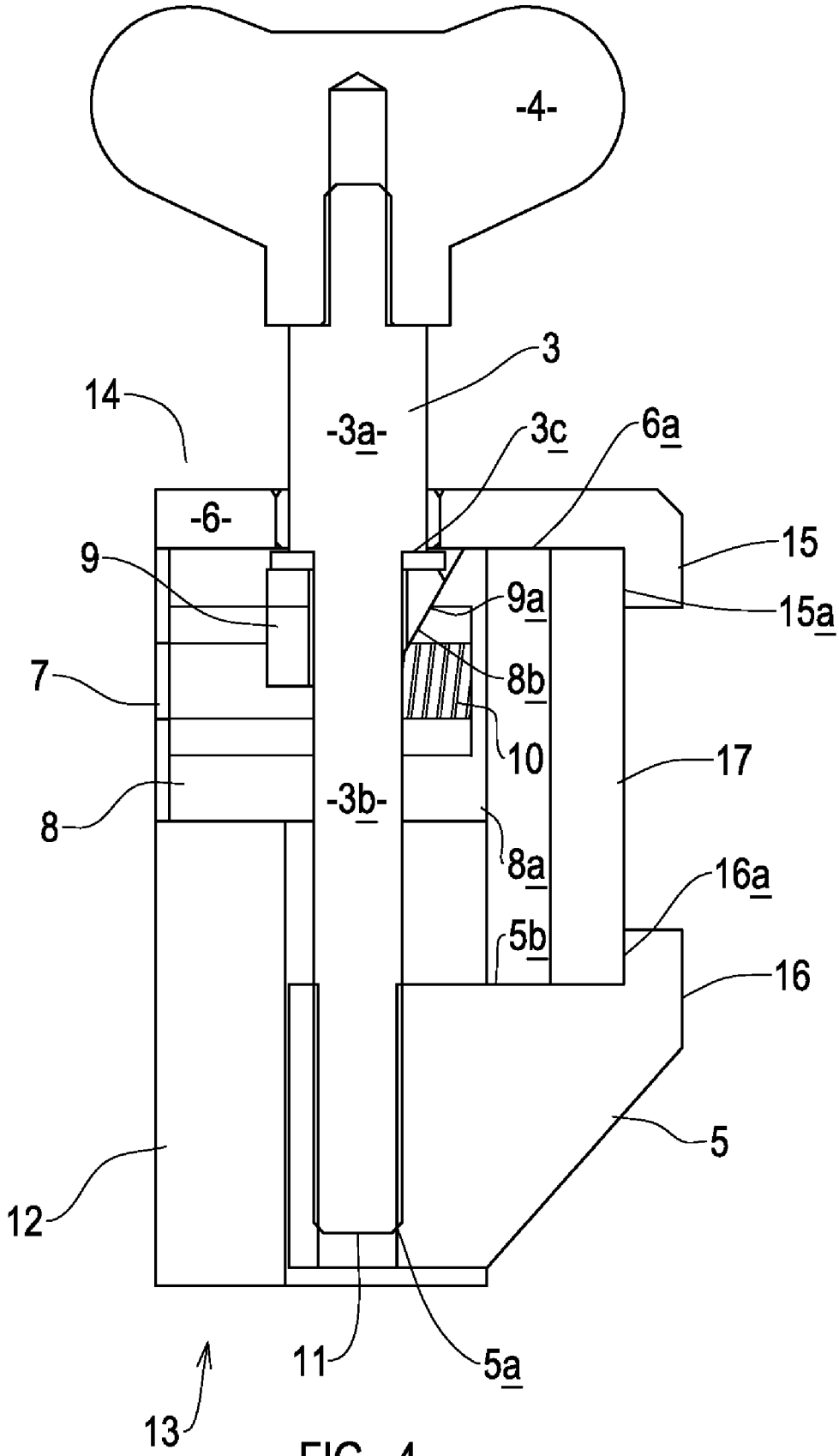
FIG. 4 shows a cross-sectional view of a clamp and rail in a second configuration.

Accordingly, the object 17 to be clamped is (through sufficient rotation of the shaft 3) secured from movement along an axis parallel to the longitudinal axis of the elongate body 12 of the housing 2 by the first 6*b* and second 5*b* major abutment surfaces of the first 6 and second 5 jaw members. The clamp 1 is said to be in a second configuration as shown in FIG. 4.

In the second configuration, the object 17 may still have a degree of freedom of movement in a direction which is generally perpendicular to the longitudinal axis of the elongate body 12 of the housing 2.

The second jaw member 5 of the clamp 1 is generally prevented from further movement towards the second end 14 of the elongate body 12 of the housing 2 by the object 17 which is being clamped. Thus, further rotation of the shaft 3 causes the shaft 3 to move towards the first end 13 of the elongate body 12 of the housing 2 (i.e. a linear movement with respect to the housing 2). This movement is against the biasing force, which is applied by the resilient biasing mechanism 10 to the slider 8 and, in turn, to the driving wedge 9 and the surface 3*c* of the shaft 3 at the interface between the first 3*a* and second 3*b* portions thereof. As such, the driving wedge 9 is also moved towards the first end 13 of the elongate body 12 of the housing 2. The inclined surface 9*a* of the driving wedge cooperates with the inclined surface 8*b* of the slider 8, and this action causes the slider 8 to move along the slider receiving channel 7 towards the object 17 to be clamped.

Figure 5:
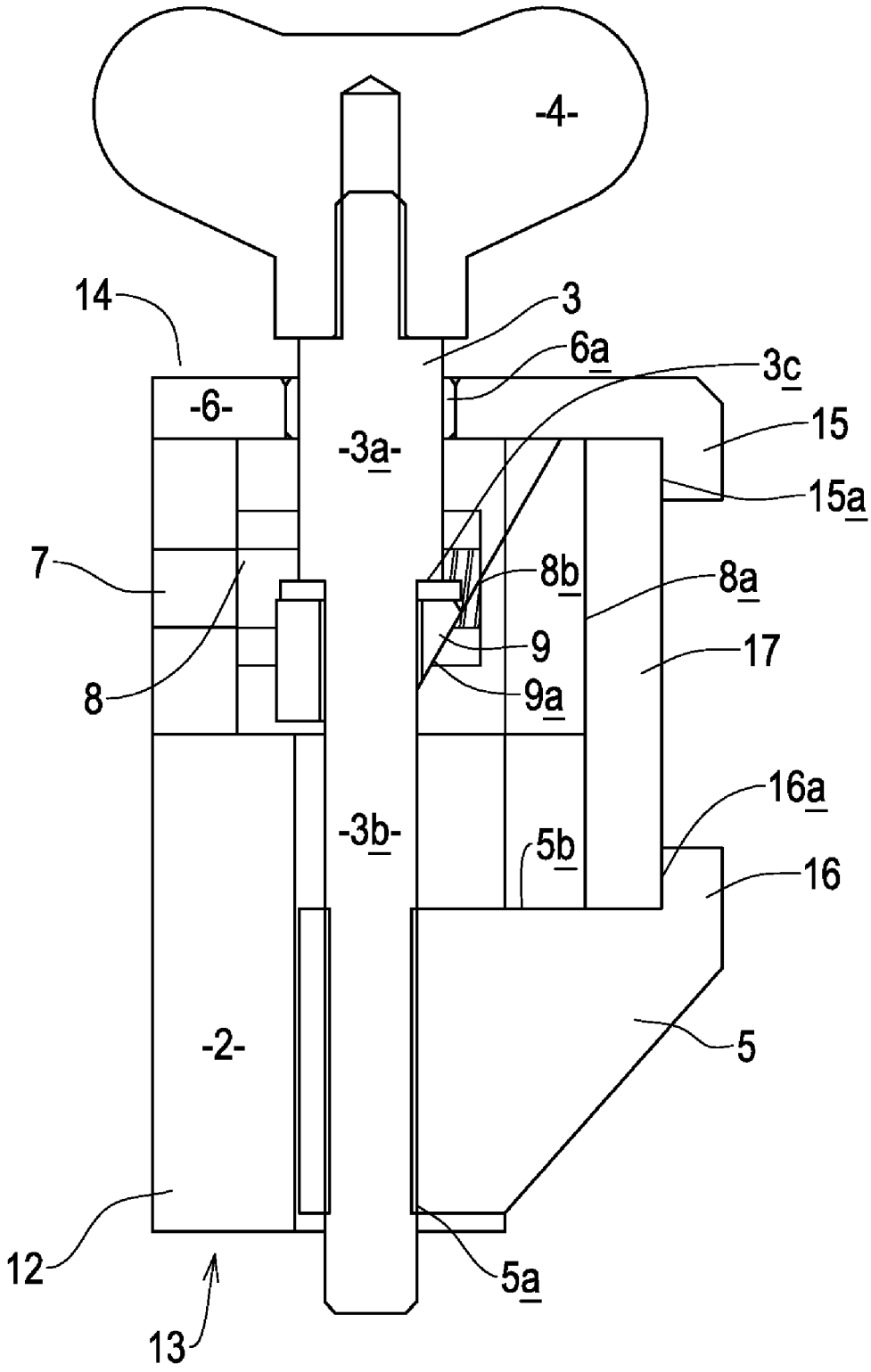
FIG. 5 shows a cross sectional view of a clamp and rail in a third configuration.

Thus, with sufficient further rotation of the shaft 3, the abutment surface 8*a* of the slider 8 abuts the object 17 to be clamped. If the object 17 does not already abut the first 15*a* and second 16*a* abutment surfaces, then still further rotation of the shaft 3 will clamp the object 17 between the abutment surface 8*a* of the slider and the first and second abutment surfaces 15*a*,16*a*. The clamp 1 is in a third configuration as shown in FIG. 5.

The object 17 can be released by rotating the shaft 3 in the opposite direction.

It will be appreciated that the present invention can be utilized to clamp to objects together. A further object 18 may be attached to the clamp 1 and, thus, the clamp may be utilized to secure the further object 18 with respect to the object 17 which is clamped by the clamp 1. The further object may be another clamp 18 of the same, or a different type. More than one further object 18 may be attached to the clamp 1.

Rotational movement of the shaft 3 may be achieved by the use of a motor (not shown).

Pressure sensors (not shown) can be used to ensure that a correct clamping pressure is applied to the object 17. Torque sensors (not shown) may be utilised to ensure that the shaft 3 is rotated such the correct clamping pressure is applied to the object 17.

A slider release mechanism (not shown) may be provided to allow movement of the slider to be controlled. The mechanism may be connected to one or more pressure or torque sensors. As such, when the correct clamping pressure has been achieved between the first and second jaw members 5,6, the slider 8 is released so as to allow movement thereof. This process may be fully automated.

The clamp 1 may be a medical apparatus clamp which is adapted to secure an item of a medical apparatus to a rail.

It will be understood that the shaft 3 comprises a clamp actuator and that other mechanisms for actuating the clamp 1 are envisaged.

The first 6*b* and second 5*b* major abutment surfaces of the clamp 1 form a first clamping axis and the first 15*a* and second 16*a* abutment surfaces of the abutment members 15,16 form a second clamping axis. It will be appreciated, that at least the first major 15*a* and second abutment 16*a* surfaces may be one continuous surface (and the same may be said for the second major 16*a* and the first abutment 15*a* surfaces). Each clamping axis is defined, therefore, by at least one pair of clamping surfaces which are operable to move between a closed and an open position. The clamping surfaces are located on respective clamp members (which include the first 6 and second 5 jaw members, and the slider 8).

The first and second clamping axes are substantially straight axes and are not, for example, substantially curved or arcuate. In an embodiment the first and second clamping axes are substantially perpendicular to each other.

It will be understood that the present invention may be adapted to clamp objected of various different shapes and sizes, and is not limited to objects with a rectangular cross-section.

In the above described embodiment of the invention, the clamping axes are perpendicular to each other; however, it will be appreciated that this need not be the case. In order to ensure that the object is sufficiently clamped against movement, it is, in some circumstances, only necessary to provide two axes which are not parallel (i.e. the two axes intersect each other).

When used in this specification and claims, the terms "comprises" and "comprising" and variations thereof mean that the specified features, steps or integers are included. The terms are not to be interpreted to exclude the presence of other features, steps or components.

The features disclosed in the foregoing description, or the following claims, or the accompanying drawings, expressed in their specific forms or in terms of a means for performing the disclosed function, or a method or process for attaining the disclosed result, as appropriate, may, separately, or in any combination of such features, be utilized for realizing the invention in diverse forms thereof.

I claim:

1. A clamp adapted to be removably fixed to a rail, said clamp comprising:

first and second clamp members, each member being configured to apply a clamping force to the rail, and one clamp actuator adapted to drive movement of both the first and second clamp members with respect to each other along respective first and second axes, wherein the first axis intersects the second axis within the rail, the first and second axes are substantially straight axes;

and the clamp actuator comprises a rotatable shaft which is configured to drive movement of both the clamp members towards a closed position by rotation of the shaft in a first direction, wherein the clamp actuator is configured to cause movement of the first clamp member and when said movement of the first clamp member is substantially complete, to cause movement of the second clamp member.

2. The clamp of claim 1, wherein the first and second axes are substantially perpendicular to each other.

3. The clamp of claim 1, wherein the clamp actuator comprises a motor.

4. The clamp of claim 1, wherein the second clamp member comprises an inclined surface cooperative with an inclined surface on a driving wedge attached to the shaft, the shaft having linear movement with respect to the second clamp member, causing the driving wedge to drive movement of the second clamp member along the second axis.

5. The clamp of claim 4, wherein movement of the second clamp member is driven by the driving wedge after a movement of the first clamp member has ended.

6. The clamp of claim 1, wherein the first clamp member defines a threaded aperture cooperative with a threaded portion of the shaft, rotation of the shaft causing movement of the first clamp member along the shaft.

7. The clamp of claim 6, wherein the second clamp member comprises an inclined surface cooperative with an inclined surface on a driving wedge attached to the shaft, the shaft having linear movement with respect to the second clamp member, causing the driving wedge to drive movement of the second clamp member along the second axis.

8. The clamp of claim 7, wherein movement of the second clamp member is driven by the driving wedge after a movement of the first clamp member has ended.

9. The clamp of claim 1, being a medical apparatus clamp.

10. A clamp adapted to be removably fixed to a further object, said clamp comprising:

first and second clamp members, each member being configured to apply a clamping force to said further object, and one clamp actuator adapted to drive movement of both the first and second clamp members with respect to each other along respective first and second axes, wherein the first axis intersects the second axis within said further object;

wherein the clamp actuator is configured to cause movement of the first clamp member, when said movement of the first clamp member is substantially complete, the second clamp member has movement.

* * * * *